United States Patent [19]

Dennison

[11] Patent Number: 4,995,125

[45] Date of Patent: Feb. 26, 1991

[54] BEDDING BOX SPRING HAVING SNAP-FIT MODULAR ELEMENTS

[75] Inventor: Timothy D. Dennison, Carthage, Mo.

[73] Assignee: Leggett & Platt, Incoporated, Carthage, Mo.

[21] Appl. No.: 564,055

[22] Filed: Aug. 7, 1990

[51] Int. Cl.[5] ..... A47C 23/04

[52] U.S. Cl. ..... 5/247; 5/255; 5/268; 5/273

[58] Field of Search ..... 5/247, 255, 260, 268, 5/275–277, 273; 267/91, 100, 103

[56] References Cited

U.S. PATENT DOCUMENTS

| | | | |
|---|---|---|---|
| 2,197,131 | 4/1940 | Levine | 5/273 |
| 3,577,574 | 5/1971 | Ciampa et al. | 5/276 X |
| 3,681,794 | 8/1972 | Ciampa et al. | 5/247 |
| 3,725,965 | 4/1973 | Smith et al. | 5/247 X |
| 3,774,248 | 11/1973 | Huras et al. | 5/273 X |
| 4,510,635 | 4/1985 | Woffendin . | |
| 4,685,162 | 8/1987 | Higgins et al. . | |

*Primary Examiner*—Michael F. Trettel
*Attorney, Agent, or Firm*—Wood, Herron & Evans

[57] ABSTRACT

A box spring for supporting a bedding matress. The box spring includes a rectangular base frame, a plurality of modular spring elements mounted atop the base frame, and a wire grid mounted atop the modular spring elements. Each of the modular spring elements comprises a horizontal straight center section terminating in horizontal plane curved end sections, at leat some of the curved end sections having single revolution coil springs extending vertically downwrad therefrom. The modular spring elements are arranged in parallel rows with adjacent spring elements of each row having alternatingly aligned straight center sections and adjacent modular elements within each row having a space between the curved end sections of the elements. The curved end sections of the modular spring elements are snap-fitted into upwardly open offset hooks in transverse wires of the wire grid.

9 Claims, 2 Drawing Sheets

10 FIG. 1

BEDDING BOX SPRING HAVING SNAP-FIT MODULAR ELEMENTS

FIELD OF THE INVENTION

This invention relates to box springs and more particularly, to box springs having improved modular spring elements that snap-fit into the wire grid of the box spring for resiliently supporting a mattress atop the box spring.

BACKGROUND OF THE INVENTION

Box springs have traditionally comprised a wooden base frame, a plurality or matrix of coil springs mounted atop the wooden base frame, and a planar mattress supporting surface located atop the coil spring. Quite commonly, that planar mattress supporting surface comprised the top turns or revolutions of the coil springs and a series of helical springs which interconnected those top turns to a border wire. In an effort to reduce the quantity of wire in a box spring and improve the mattress support, modular spring coils that form two coils from a single strand of wire interconnected by straight length of wire extending between the top turns of the two interconnected coils were developed. Such modular spring coils are disclosed in U.S. Pat. No. 4,510,635. In this patent, modular spring elements are held in the top planar mattress supporting surface by a series of helical lacing wires extending between opposite sides of the border wire.

In an effort to improve upon the box spring disclosed in the above identified patent, the helical lacing wires for interconnecting the modular spring elements in the top plane of the box spring were replaced by a wire grid. This improvement is the subject of U.S. Pat. No. 4,685,162. According to the disclosure of this patent, the wires of the grid have U-shaped channels formed thereon and the overlapping ends of adjacent modular spring elements are received and secured within these U-shaped channels. After the overlapping end portions of the adjacent modular spring elements are received within the channels, the channels are crimped shut to secure the spring elements in the grid.

While the box spring of U.S. Pat. No. 4,685,162 eliminates helical lacing wires in the top plane of the box spring together with their attendant production problems and expenses, it too gives rise to manufacturing and production problems. Specifically, it requires crimping of the grid channels around a modular spring element in order to secure the modules to the grid. This, of course, is a time consuming and relatively expensive manufacturing process. It has therefore been an objective of the invention to provide an improved box spring in which spring modules of the types disclosed in the above identified patent may be interconnected in the top planar surface of the box spring without requiring the crimping of the grid channels or overlapping of the curved ends of the modular elements within the channels of the grid.

SUMMARY OF THE INVENTION

The present invention provides a box spring in which modular spring elements may be assembled to a wire grid of the box spring without overlapping of the modular spring elements or crimping of grid wires about the curved ends of the modular spring elements thereby reducing the time required to assemble the box spring.

According to the practices of this invention, the box spring includes a rectangular base frame having a pair of opposed side members interconnected at each end to a pair of opposed end members. Longitudinal slats extend between the opposed end members and underlie transverse slats extending between the side members. A plurality of modular spring elements are mounted atop the base frame with each modular spring element having a horizontal straight center section which terminates in curved, horizontal end sections with at least some curved end sections having spring sections that extend vertically downward for attachment to the base frame. The modular spring elements are arranged in parallel rows with adjacent elements of each row being spaced apart from adjacent spring elements within the same row. In one preferred embodiment, the modular elements within each row are arranged so the straight center sections are alternatingly aligned.

The box spring further includes a wire grid mounted atop the modular spring elements, the wire grid has a rectangular border wire and parallel pairs of wires extending between the opposite sides of the border wire. The curved end sections of the modular spring elements are snap-fit within offset hooks formed in the parallel grid wires with the curved end sections of the modular spring elements extending beneath the grid wires on opposite sides of the offset hooks and above the upwardly open section of the offset hooks.

The box spring of this invention has the advantage over prior art box springs of being less expensive and requiring less effort to assemble while retaining the same overall dimensions, firmness and resiliency characteristics of previously known box springs. Additionally, this box spring provides improved support of the top wire grid and of a mattress supported atop the grid.

DESCRIPTION OF THE PREFERRED EMBODIMENT

Figure 1:
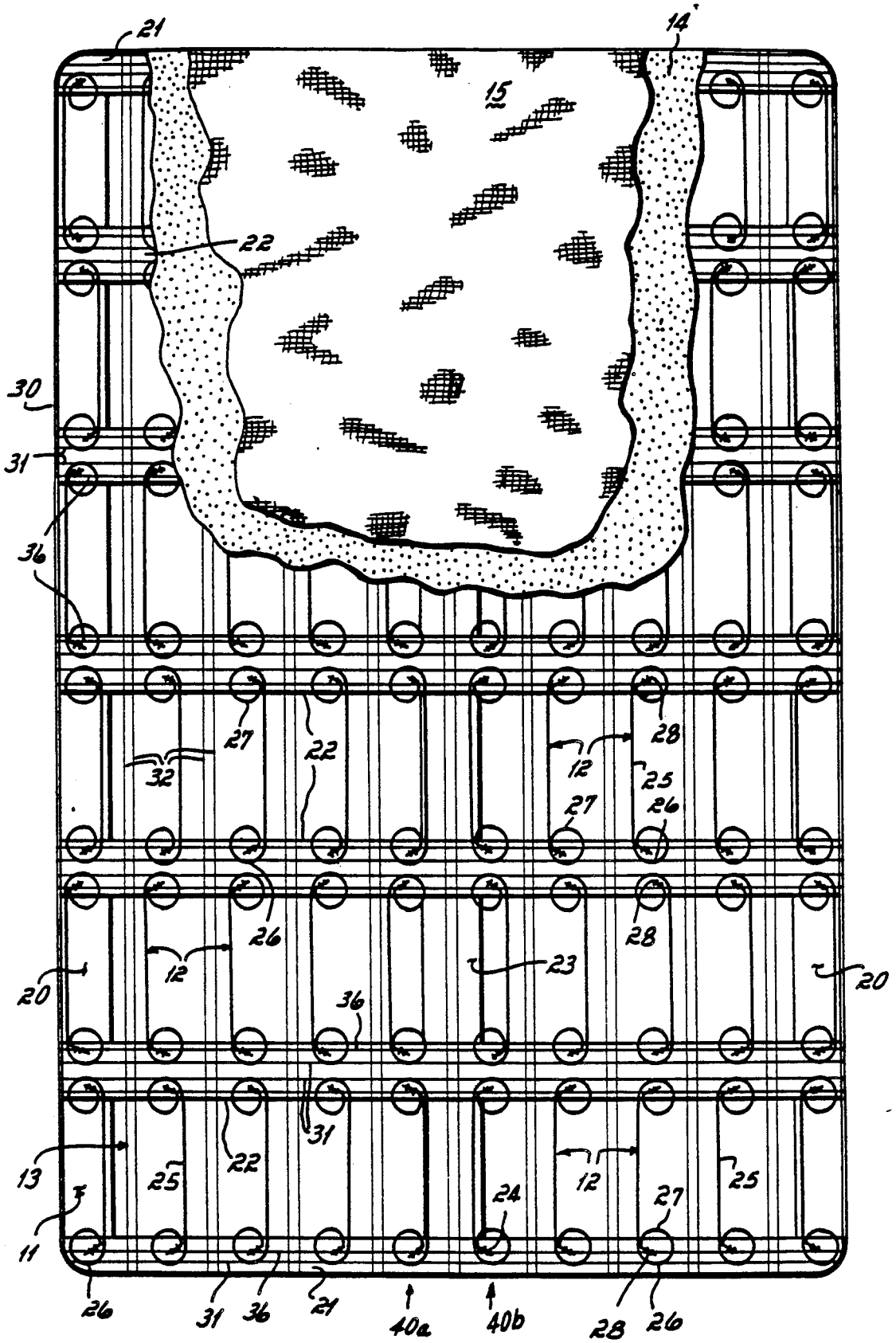
FIG. 1 is a top plan view, partially broken away, of a box spring incorporating the invention of this application.

With reference first to FIG. 1, there is illustrated a box spring 10 incorporating the invention of this application. This box spring comprises a conventional rectangular wooden base frame 11, a plurality of identical resilient modular elements 12 mounted atop the base frame 11, and a wire grid 13 supported by the modular elements 12 approximately 5" above the base frame 11. Covering the wire grid there is a conventional fabric pad 14. The complete box spring assembly, including the base frame 11, modular elements 12 and wire grid 13, as well as fabric pad 14, are encased within a conventional upholstered covering 15.

Figure 2:
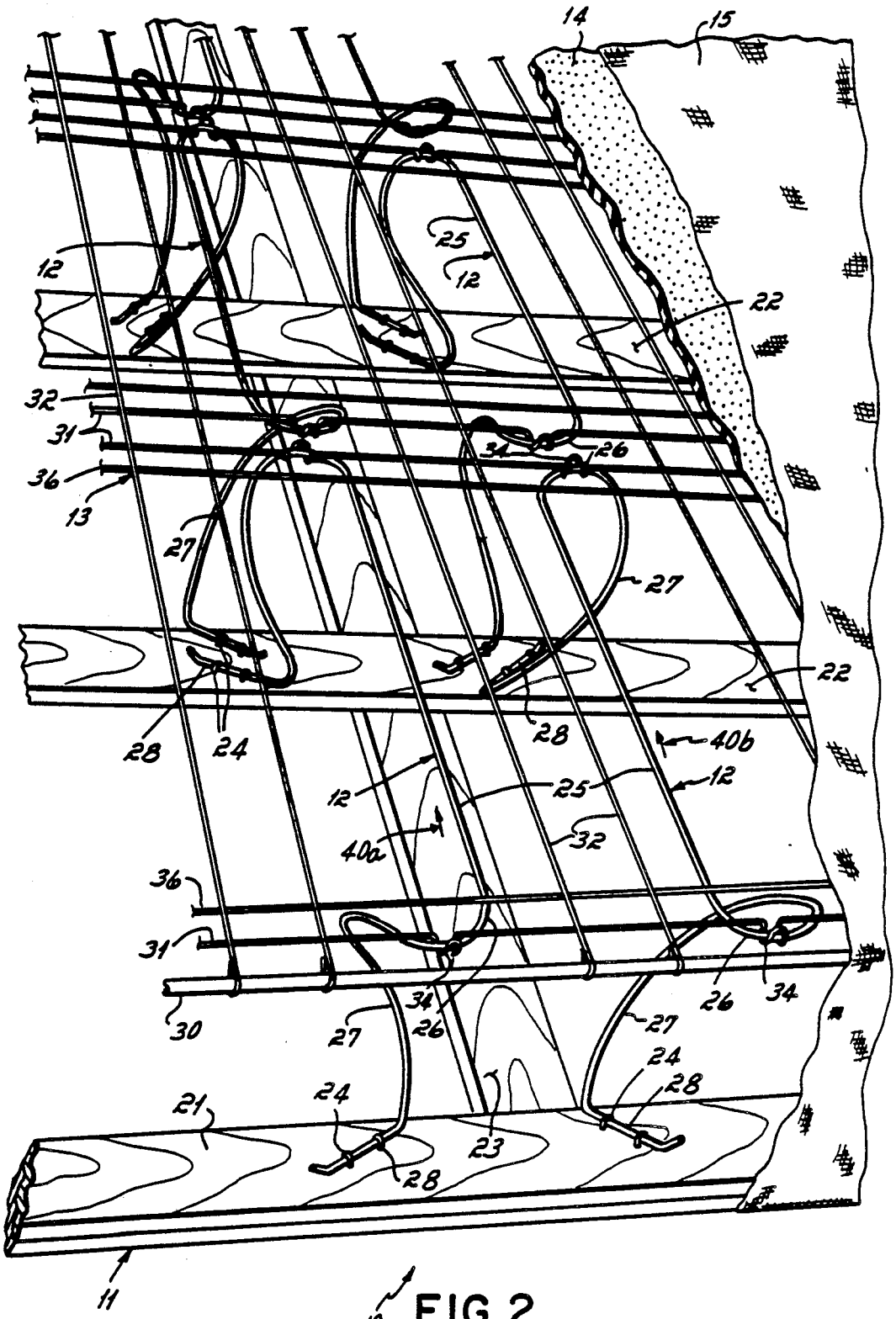
FIG. 2 is a fragmentary perspective view of the central longitudinal section of the box spring assembly of FIG. 1.

With reference to FIG. 2, it can be seen that the base frame 11 comprises a pair of opposed side boards 20 connected at the ends by end boards 21. Fixedly secured to and extending between end boards 21 is a longitudinal slat 23 while extending between and fixedly secured to side boards 20 are transverse slats 22. The longitudinal slat 23 underlies and supports the transverse slats 22.

Again with reference to FIG. 2, each modular element 12 is manufactured from a single strand of wire having a straight central section 25 which terminates at each end in a curved or arcuate end section 26. Extending from each curved end section, there is a single revolution coil spring leg 27. Each of these coil spring legs 27 in turn terminates at its lower end in a generally right angle end section or foot 28. The foot 28 is stapled or otherwise fixedly secured to the top of the end boards 21 and slats 22 of the base frame 11 by staples 24. In accordance with the practice of this invention, each of the single revolution coil spring legs 27 of the modular elements 12 is approximately 2" in diameter and approximately 5 to 5½" in height. When so dimensioned, the modular element of this invention has been found to have the desirable firmness characteristics required for a spring module usable in a box spring of approximately 6" overall height. This is a relatively standard height for box springs in the United States and in some foreign countries.

The wire grid 13 includes a rectangular border wire 30 overlying the peripheral edge of the rectangular base frame 11. A plurality of longitudinal wires 32 extend from the opposed ends of border wire 30 to provide rigidity to the wire grid 13. A plurality of transverse grid wires 31, 36 extend between opposed sides of the border wire. The ends of these grid wires 31, 32 and 36 are bent around and preferably welded to the border wire 30 and the intersections of the grid wires 31, 32 and 36 are preferably welded together. Intermediate the ends of the transverse grid wires 31 are a plurality of equidistantly spaced, generally upwardly opened offset hooks 34 formed in the grid wires 31. The number of such upwardly open offset hooks depends upon the number of rows of modular elements to be connected by the offset hooks 34 to the grid.

The upwardly open offset hooks 34 formed in grid wires 31 are composed of two U-shaped sections parallel to one another that are normal to the same side of transverse wire 31 with one end of each U-shaped section connected to the transverse wire 31. The ends of the U-shaped section that are not attached to grid wire 31 are then joined by an edge loop to form the upwardly open offset hook or channel 34.

With further reference to FIG. 2, it can be seen that the modular elements 12 are arranged in longitudinally extending rows 40*a* and 40*b*. Within each row, adjacent modular elements 12 have the straight central sections 25 aligned in an alternating offset manner. The curved end sections 26 of adjacent modular elements 12 within a row underlie different transverse grid wires 31 so that a space exists between the two curved end sections 26. Each end section 26 that underlies a grid wire 31 is received within a U-shaped offset hook 34 so that the curved section 26 rests within the base of each U-shaped section. A plurality of transverse wires 36 that do not have offset hooks formed therein extend between opposed sides of the border wire 30 parallel to and interiorly of a pair of transverse wires 31. The offset hooks 34 formed in the pair of transverse wires 31 oppose one another to form a pocket for the snap-fitting of the modular elements 12 to the wire grid 13. The grid wires 36 overlie the modular elements 12 and provide additional support for the mattress support surface and ultimately the box spring itself.

In order to secure the modular elements 12 to the wire grid 13, one curved end 26 is placed within an upwardly open offset hook 34 and the other curved end 26 of the modular element 12 is aligned below the upwardly open offset of a transverse grid wire 31 within a row of modular elements. The curved end underlying the upwardly open offset is then pushed beyond the edge loop forming part of the upwardly open offset 34 and then raised above the edge loop, permitting the curved end section 26 to snap within the upwardly open offset 34 to secure modular element 12 within the wire grid 13.

After completion of the spring assembly by connection of the modular elements 12 to the base frame 11 and subsequent attachment of the grid 13 to the modular elements 12 by snap-fitting the curved end sections 26 within the offset hook 34 of the transverse wires 31, the box spring is completed by placement of the fabric pad 14 over the top of the wire grid 13. The complete assembly is then encased within a conventional upholstery covering 15.

One advantage of this box spring assembly is the simplified assembly of the box spring provided by snap-fitting the modular spring elements into the wire grid. The snap-fitting of the modular springs does not require the permanent deformation of either the transverse wires or modular springs. Additionally, the box spring of this invention provides improved support of the grid and thus a mattress supported atop the grid over other previously known box springs employing the same modular spring elements as used in the box spring of the current invention.

While we have only described a preferred embodiment of the invention, persons skilled in the art to which this invention pertains will readily appreciate changes and modifications which may be made without departing from the spirit of our invention. Therefore, we do not intend to be limited except by the scope of the following appended claims.

We claim:

1. A box spring for supporting a bedding mattress, said box spring comprising a rectangular base frame, said base frame comprising a pair of opposed side members, a pair of opposed end members, and transverse slats extending between said side members, a plurality of modular spring elements mounted atop said base frame, each of said modular spring elements comprising a horizontal straight center section terminating in curved horizontal end sections, at least some curved end sections having spring sections extending vertically downwardly therefrom, said modular elements being arranged in parallel rows with adjacent elements of each row being spaced apart at said curved end sections, a wire grid mounted atop said modular elements, said wire grid comprising a rectangular border wire and a plurality of pairs of wires extending between opposed sides of said border wire, each wire of said pairs of wires having a plurality of upwardly, open offset hooks formed therein, said offset hooks of one wire of each pair of wires being opposed to said offset hooks of the other wire of the same pair, and each pair of wires having a plurality of modular spring elements extending therebetween with the curved end sections of said modular elements being snap-fitted into said offset hooks such that said curved end sections of said modular elements extend beneath said grid wires on opposite sides of each of said offset hooks and are located above the open section of each of said offset hooks, a fabric pad overlying said wire grid, and an upholstered covering encasing said base frame, said modular elements, said wire grid, and said fabric pad.

2. A box spring for supporting a bedding mattress, said box spring comprising a rectangular base frame, said base frame comprising a pair of opposed side members, a pair of opposed end members, and transverse slats extending between said side members, a plurality of modular elements mounted atop said base frame, each of said modular elements comprising a horizontal straight center section terminating in curved horizontal end sections, at least some curved end sections having spring sections extending vertically downwardly therefrom, said modular elements being arranged in parallel rows with adjacent elements of each row being spaced apart at said curved end sections, a wire grid mounted atop said modular elements, said wire grid comprising a rectangular border wire and a first plurality of pairs of wires extending between opposed sides of said border wire, each wire of said first plurality of said pairs of wires having a plurality of upwardly open offset hooks formed therein, said offset hooks of one wire of each pair of said first plurality of wire pairs being opposed to offset hooks of the other wire of the same pair, said curved end sections of said modular elements being snap-fitted into said offset hooks such that said curved end sections of said modular elements extend beneath the said grid wires on opposite sides of said offset hooks and above the open section of said offset hooks.

3. The box spring of claim 2, said wire grid further comprising a second plurality of pairs of parallel wires extending from said opposed sides of said border wire, each wire of said second plurality of pairs overlying at least one straight center section of said modular elements.

4. The box spring of claim 3, said wire grid further comprising a plurality of additional wires extending from opposed ends of said border wire and normal to said first plurality of pairs of wires.

5. The box spring of claim 4, said offset hooks formed in said first plurality of pairs of wires further comprising two U-shaped sections parallel to and spaced apart from one another and perpendicular to said wire formed thereon, each U-shaped section being connected at one end to said wire formed thereon and having the ends remote from said wire formed thereon joined by an edge loop.

6. The box spring of claim 5 wherein said plurality of additional wires are equidistantly spaced between adjacent rows of said modular elements.

7. A box spring for supporting a bedding mattress, said box spring comprising a rectangular base frame, said base frame comprising a pair of opposed side members, a pair of opposed end members, and transverse slats extending between said side members, a plurality of modular elements mounted atop said base frame, each of said modular elements comprising a horizontal straight center section terminating in curved horizontal end sections, at least some curved end sections having spring sections extending vertically downwardly therefrom, said modular elements being arranged in parallel rows with adjacent elements of each row being spaced apart at said curved end sections, said spring sections of said modular elements each including a single revolution coil spring, a wire grid mounted atop said modular elements, said wire grid comprising a rectangular border wire and first pairs of substantially straight wires extending between opposed sides of said border wire, each wire of said first pairs of wires having at least one upwardly open offset hook formed therein, said offset hooks of each pair of wires being opposed to one another, said curved end sections of said modular elements being snap-fitted into said offset hooks such that said curved end sections of said modular elements extend beneath the grid wires on opposite sides of said offset hooks and above the open section of said offset hooks.

8. The box spring of claim 7 wherein said straight center sections of said modular spring elements forming a row of modular spring elements are alternatingly aligned.

9. A box spring for supporting a bedding mattress, said box spring comprising a rectangular base frame, said base frame comprising a pair of opposed side members, a pair of opposed end members, and transverse slats extending between said side members, a plurality of modular elements mounted atop said base frame, each of said modular elements comprising a horizontal straight center section terminating in curved horizontal end sections, at least some curved end sections having spring sections extending vertically downwardly therefrom, said modular elements being arranged in parallel rows with adjacent elements of each row being spaced apart at said curved end sections, said spring sections of said modular elements each including a single revolution coil spring approximately five inches in height and two inches in diameter extending between said curved sections of said modular elements and said base frame, a wire grid mounted atop said modular elements, said wire grid comprising a rectangular border wire and a first plurality of pairs of wires extending between opposed sides of said border wire, each wire of said first plurality of pairs of wires having at least one upwardly open offset hook formed therein, said offset hooks of each of said pairs of wires being opposed to one another, said curved end sections of said modular elements being snap-fitted into said offset hooks such that said curved end sections of said modular elements extend beneath the wires on opposite sides of said offset hooks and above the open section of said offset hooks.

* * * * *

UNITED STATES PATENT AND TRADEMARK OFFICE

CERTIFICATE OF CORRECTION

PATENT NO. : 4,995,125

DATED : February 26, 1991

INVENTOR(S) : Timothy D. Dennison

It is certified that error appears in the above-identified patent and that said Letters Patent is hereby corrected as shown below:

In the Abstract, line 1, change "matress" to --mattress--.

In the Abstract, line 7, change "leat" to --least--.

In the Abstract, line 9, change "downwrad" to --downward--.

Signed and Sealed this

First Day of September, 1992

*Attest:*

DOUGLAS B. COMER

*Attesting Officer*

*Acting Commissioner of Patents and Trademarks*